United States Patent [19]

Pai et al.

[11] Patent Number: 5,030,536

[45] Date of Patent: Jul. 9, 1991

[54] PROCESSES FOR RESTORING AMORPHOUS SILICON IMAGING MEMBERS

[75] Inventors: Damodar M. Pai, Fairport; Santokh S. Badesha, Pittsford, both of N.Y.

[73] Assignee: Xerox Corporation, Stamford, Conn.

[21] Appl. No.: 456,402

[22] Filed: Dec. 26, 1989

[51] Int. Cl.[5] ..... G03G 5/082

[52] U.S. Cl. ..... 430/127; 430/66; 427/307; 427/309; 427/327; 427/343; 156/657; 156/662; 156/94; 134/41; 134/42

[58] Field of Search ..... 430/127, 66, 67; 427/307, 309, 327, 343, 344; 156/657, 662, 94; 134/41, 42

[56] References Cited

U.S. PATENT DOCUMENTS

| | | | |
|---|---|---|---|
| 3,020,175 | 2/1962 | Penczek et al. | 427/327 X |
| 4,382,071 | 5/1983 | Otsuka et al. | 423/341 |
| 4,468,443 | 8/1984 | Shimizu et al. | 430/60 |
| 4,849,315 | 7/1989 | Pai et al. | 430/84 |

*Primary Examiner*—David Welsh
*Attorney, Agent, or Firm*—E. O. Palazzo

[57] ABSTRACT

A process for restoring imaging members, which comprises (1) providing, subsequent to its utilization and removal from an electrophotographic imaging device, an amorphous silicon photoconductive imaging member with a protective overcoating; (2) contacting this member with a fluorine containing composition for an effective time period enabling the removal of the protective layer; (3) washing and drying the surface of the resulting imaging member; and (4) subsequently depositing a protective layer thereover.

35 Claims, No Drawings

PROCESSES FOR RESTORING AMORPHOUS SILICON IMAGING MEMBERS

BACKGROUND OF THE INVENTION

This invention is generally directed to processes for treating imaging members such as amorphous silicon, and more specifically, the present invention is directed to a simple direct, economically attractive process for restoring amorphous silicon photoconductive substances with fluorine containing compositions. In one embodiment, the present invention is directed to a process for treating and restoring hydrogenated or halogenated amorphous silicon photoconductive substances including drums with fluorine containing compositions, such as hydrofluoric acid, thereby for example increasing the charge acceptance of these substances. Moreover, in accordance with the process of the present invention amorphous silicon containing undesirable invisible latent scratches on the surface thereof can be treated with fluorine containing substances for the purpose of eliminating the print out of these scratches. Further, in accordance with the process of the present invention image defects which appear as white spots obtained with previously commercially used electrophotographic overcoated amorphous silicon devices can be eliminated. Additionally, by treating amorphous silicon in accordance with the process described hereinafter aging of stored photoconductive drums, which translates into loss of image resolution, can be prevented. Another embodiment of the present invention is specifically directed to restoring used, especially commercially used, amorphous silicon imaging members including drums comprised of amorphous silicon, especially hydrogenated amorphous silicon, and or halogenated amorphous silicon which may contain dopants and contain a protective overcoating layer. The processes of the present invention may also be applicable to the treatment of imaging members comprised of amorphous silicon, including hydrogenated amorphous silicon, and/or halogenated amorphous silicon.

In an embodiment of the present invention, the process comprises restoring hydrogenated or halogenated amorphous silicon imaging members with protective overcoatings by exposing these members to vapors of hydrogen fluoride for an effective time period of, for example, from about 1 minute to about 240 minutes thereby removing the protective overcoating of, for example, silicon carbide, silicon nitride, amorphous carbon, and the like; spray washing the surface of the resulting member; drying the surface; and subsequently depositing a protective overcoating thereby resulting, for example, in a member that when reincorporated into electrophotographic imaging devices enables the achievement of images of increased resolution with substantially no white spots as compared to the member prior to treatment, which is substantially unusable.

Amorphous silicon photoconductors treated in accordance with the process of the present invention are useful as photoconductive imaging members in an electrophotographic imaging or printing apparatus wherein, for example, electrostatic latent images formed on the surface thereof are developed with toner particles, transferred to a suitable substrate such as paper, and subsequently optionally permanently affixed thereto by heat, for example.

Electrophotographic imaging systems, particularly xerographic imaging systems, are well known, and are extensively described in the prior art. In these systems, generally a photoresponsive or photoconductor material is selected for forming the latent electrostatic image thereon. This photoreceptor is generally comprised of a conductive substrate containing on its surface a layer of photoconductive material, and in many instances a thin barrier layer is situated between the substrate and the photoconductive layer to prevent charge injection from the substrate as injection would adversely effect the quality of the resulting image. Examples of known useful photoconductive materials include amorphous selenium, alloys of selenium such as selenium tellurium, selenium arsenic, and the like. Additionally, there can be selected as the photoresponsive imaging member various organic photoconductive materials, including, for example, complexes of trinitrofluorenone and polyvinyl carbazole. Recently, there have been disclosed layered organic photoresponsive devices containing separate charge transport and photogenerating layers. Examples of charge transport layers include various diamines, while useful photogenerating compositions include trigonal selenium, metal and metal-free phthalocyanines, vanadyl phthalocyanines, and the like.

In the patentability search report, there were located the following U.S. Pat. Nos. 4,382,071 directed to a process for preparing silicon tetrafluoride using hydrogen fluorine gas, reference the Abstract of the Disclosure, and note column 1, lines 16 to 18; according to the teachings of this patent, hydrogen fluoride gas is employed as a fluorine source to avoid water in the reaction system and this gas can be introduced into the reaction system at a desired rate and rapidly dissolves in sulfuric acid, which is used as the liquid dispersion medium to react with the dispersed silicon oxide, see column 2, lines 25 to 46; 4,468,443 directed to a process for producing photoconductive members from gaseous silicon compounds, see the Abstract of the Disclosure for example, and note column 2, lines 15 to 54, wherein a photoconductive layer, which comprises substance for formation of such a layer under a gaseous state, is disclosed; as starting substances effectively used for the incorporation of carbon atoms, there can be selected a number of materials, reference column 5; and note the combination compounds represented by the formula B in column 6, beginning at line 35, including $SiF_4$; and 4,849,315 mentioned herein, which relates to processes for restoring halogenated and hydrogenated amorphous silicon imaging members wherein the member subsequent to its utilization in and removal from an electrophotographic imaging apparatus is contacted with a fluorine containing composition, reference the Abstract of the Disclosure.

Also known are amorphous silicon photoconductors, reference for example U.S. Pat. No. 4,265,991. There is disclosed in this patent an electrophotographic photosensitive member containing a substrate, a barrier layer, and a photoconductive overlayer of amorphous silicon containing 10 to 40 atomic percent of hydrogen, and having a thickness of 5 to 80 microns. Additionally, this patent describes several processes for preparing amorphous silicon. In one process, there is prepared, according to the teachings of this patent, an electrophotographic sensitive member by heating the member contained in a chamber to a temperature of 50° C. to 350° C. introducing a gas containing silicon and hydrogen atoms into the chamber causing an electrical discharge in the space of the chamber, followed by depositing amorphous silicon on an electrophotographic substrate at a rate of 0.5 to 100 Angstroms per second. The charge acceptance of these devices is found to be limited by the surface conditions. Further, in some instances as a result of corona interaction with the surface of the devices prepared in accordance with the process of this patent, the surface conductivity undesirably increases resulting in a loss of image resolution, and a decrease in image density within less than about 1,000 imaging cycles. Accordingly, while the amorphous silicon photosensitive devices of the '991 patent are useful, their selection as a commercial device for a number of imaging cycles is not readily achievable. Also known are the aforementioned members with protective overcoatings of silicon nitride, silicon carbide, amorphous carbon, including hydrogenated, 10 to 45 atomic percent for example, and the like. These members, especially when selected for use in commercial electrophotographic, especially xerograpahic, imaging apparatus are generally only useful for about 300,000 copies in most instances; thereafter it is the present practice to discard these members or drums and replace them with new members at a substantial cost. With the processes of the present invention, the used imaging members, including drums of amorphous silicon with protective overcoatings, can be restored and reused thereby enabling a substantial cost savings of about $500 or more per drum in an embodiment of the present invention. Generally, the restoration process of the present invention results in a cost of about $30 per drum as compared to the costs of new drums of $500 or more.

In Xerox U.S. Pat. No. 4,849,315, the disclosure of which is totally incorporated herein by reference, there is illustrated an improved process, which comprises (1) providing an amorphous silicon photoconductive substance, and (2) contacting this substance with compositions containing fluorine for a sufficient period of time to enable an increase in the charge acceptance of the photoconductive substance, and/or the elimination of surface scratches contained thereon by, for example, etching away the old surface and reforming a new surface. In one specific embodiment of the aforementioned patent, there is provided an improved process for treating amorphous silicon photoconductive materials, which comprises (1) providing a virgin unused amorphous silicon photoconductive substance, and (2) contacting this substance with vapors generated from hydrofluoric acid for a period of time of from about one minute to about 240 minutes, and preferably from about 10 minutes to about 60 minutes, wherein there results an amorphous silicon photoconductor which has increased charge acceptance and resolution as compared to amorphous silicon not treated with hydrofluoric acid vapors.

In a further specific embodiment of the aforementioned patent, there is provided an improved process for restoring hydrogenated or halogenated amorphous silicon imaging members, which comprises (1) providing a hydrogenated or halogenated amorphous silicon photoconductive member subsequent to its utilization in and removal from an electrophotographic imaging apparatus, and (2) contacting this member with vapors generated from hydrofluoric acid for a period of time of from about one minute to about 240 minutes, and preferably from about 15 minutes to about 60 minutes wherein the charge acceptance of the removed member has increased, and/or surface scratches contained therein have been substantially eliminated.

Illustrated in U.S. Pat. No. 4,357,179, the disclosure of which is totally incorporated herein by reference, is a method for preparing devices containing high density amorphous silicon or germanium wherein with respect to the amorphous silicon, n-doping or p-doping can be affected with dopants such as phosphorous or boron, reference the disclosure in column 5, beginning at line 44, and specifically at lines 55 to 65.

Also, in U.S. Pat. No. 4,237,150 there is disclosed a method for preparing hydrogenated amorphous silicon wherein ammonia is introduced into a reaction chamber with a silane gas for the purpose of enhancing the photoconductivity of the resulting hydrogenated amorphous silicon films, reference the disclosure in column 1, beginning at around line 20.

Further, U.S. Pat. No. 4,237,151 discloses the preparation of hydrogenated amorphous silicon substances by thermally decomposing silane or other gases at elevated temperatures and under specific vacuum conditions wherein a gaseous mixture of atomic hydrogen and atomic silicon result, followed by depositing this mixture onto a substrate situated outside a heated tungsten tube wherein a film of hydrogenated amorphous silicon is formed on the substrate. In column 4, beginning at line 58, it is indicated that conventional doping gases can be added to the silane if desired.

Furthermore, U.S. Pat. No. 4,356,246 describes a specific noncrystalline silicon powder having excellent photoconductivity comprised of silicon and hydrogen, which powder exhibits specific characteristics such as an infrared absorption spectrum characterized by absorption peeks centered about certain areas, reference the Abstract of the Disclosure. There is disclosed in column 5, beginning at line 41, that in addition to hydrogen, other elements such as oxygen, fluorine, chlorine, bromine, iodine, phosphorous, boron, solely or in the form of a combination, may be contained in the amorphous silicon particles for the purpose of controlling the electrical conductivity thereof.

Additionally, U.S. Pat. No. 4,361,638 discloses a light sensitive electrophotographic element including a photoconductive layer comprised of amorphous silicon and a carbon based material doped with hydrogen and fluorine, reference the disclosure in column 4, beginning at line 3.

Furthermore, U.S. Pat. No. 4,365,013, the disclosure of which is totally incorporated herein by reference, illustrates an amorphous silicon layer, which apparently can be rendered highly photoconductive by doping with hydrogen, or by doping with impurities, reference the disclosure in column 2, beginning at line 46. Doping materials disclosed include halogens such as fluorine, chlorine, bromine and iodine, reference the disclosure in column 2, beginning at line 57.

Other prior art include U.S. Pat. Nos. 4,342,044; 4,394,426; 4,468,443 and 4,490,208. In the '044 patent, reference column 4, beginning at line 54, and particularly at line 65, there is disclosed that the nonoptimum spectral response of the prior art amorphous silicon photoresponsive devices is overcome by adding one or more band gap adjusting elements to the amorphous photoresponsive alloy. More specifically, as stated at line 65, "The amorphous alloy incorporates at least one density of states reducing element, fluorine. The compensating or altering element, fluorine or elements, can be added during deposition or thereafter.". Also, disclosed in the '208 patent are methods of obtaining thin films of silicon by doping a p or n type thin film of silicon with an impurity element under a plasma discharge of gas of at least one element selected from among fluorine, chlorine, bromine, iodine, and hydrogen, reference column 1, lines 51 to 63. In the '426 patent, there is disclosed a photoconductive member containing amorphous silicon atoms as a matrix, hydrogen or halogen atoms; and as an intermediate layer an amorphous material containing, for example, silicon atoms and nitrogen atoms.

Additionally, described in U.S. Pat. No. 4,634,647, the disclosure of which is totally incorporated herein by reference, are processes for preparing amorphous silicon, which is useful for incorporation into an electrophotographic imaging apparatus, wherein images of high resolution can be obtained for a number of imaging cycles. This process involves simultaneously treating amorphous silicon with dopants such as boron and phosphorus.

Substantial interest has been directed to obtaining amorphous silicon photoreceptor materials since they possess a number of advantages in comparison to, for example, amorphous selenium based materials in that amorphous silicon is of extreme hardness and will not crystallize or wherein crystallization is minimized over extended time periods even at temperatures as high as several hundred degrees Centigrade. Additionally, especially hydrogenated or halogenated amorphous silicon photoconductors have excellent photoelectronic properties, high absorption coefficients through the visible region, and are relatively low in useful life cost in comparison to selenium photoconductors. Moreover, amorphous silicon photoreceptors are capable of ambipolarity as they can be xerographically charged, and discharged either positively or negatively in various imaging systems. Furthermore, amorphous silicon can be modified by adding various dopants thereto such as boron and phosphorus, enabling this material to function as a p or n type semiconductor device; and amorphous silicon may be alloyed with other materials including germanium and tin for the purpose of providing a material which will be photosensitive in the infrared region of the spectrum. Moreover, amorphous silicon materials are inert and nontoxic rendering them highly desirable as a photoconductive imaging member.

While processes are known for preparing amorphous silicon with protective overcoatings, in some instances these processes result in members which, after repeated usage in electrophotographic imaging devices, have decreased charge acceptance causing the resulting images to be of poor density. In addition, the images have scratch printout. Scratches, both latent and visible can be produced as a result of handling, mechanical interaction with the developer carrier beads or the cleaning system. While it is not desired to be limited by theory, it is believed that as a result of a continuous mechanical interaction of developer carrier beads with the protective surface of the amorphous silicon, undesirable scratches result thereon which if deep, for example, about one micron, can scratch through the protective overcoat of, for example, silicon carbide or nitride. The silicon-hydrogen and/or silicon-silicon bonds in the scratched regions are broken, and in the presence of water vapor are reformed into silicon-hydroxy type bonds. The charge acceptance in the regions of scratch, which is limited by the surface conditions, decreases as a result of this mechanical interaction causing an undesirable reduction in the density of the images in the scratched regions. Further, the mechanical damage caused by the developer beads during the development step lowers the charge acceptance of the entire amorphous silicon photoresponsive device or drum, and causes a corresponding decrease in the density of the total image.

Another type of mechanical damage observable with many overcoated hydrogenated or halogenated amorphous silicon imaging members is confined to small isolated areas of the surface; this damage also generally being referred to as scratches. These scratches are caused, for example, during xerographic imaging processes wherein the amorphous silicon photoconductor is subjected to cleaning with wiper blades. Furthermore, interaction of the amorphous silicon with isolated carrier particles contained in the developer mixture can cause scratches. Additionally, these scratches can be generated during the handling of an amorphous silicon (hydrogenated or halogenated) drum while it is being manufactured, and during the positioning of this drum within the machine involved. These latent scratches, which are not visible, damage the surface of the amorphous silicon causing a reduction in the charge acceptance thereof, and a print out of the scratches. Thus, subsequent to a minimum number of imaging cycles mechanical interaction of amorphous silicon member with carrier beads causes a reduction in image density wherein scratches print out. Eventually, the amorphous silicon photoreceptor, which was initially selected for its durability, may no longer be useful, and thus is discarded.

Additionally, it is believed that the degradation of the electrophotographic performance of amorphous silicon is caused by the sensitivity of the silicon imaging device to chemical alterations by exposure to a corona atmosphere, especially at high humidities. These sensitivities create fundamental limitations for the practical use of devices wherein the exposed surface contains substantially amorphous silicon. While this problem can be minimized by encapsulating the silicon with a chemically passive hard overcoating of amorphous silicon nitride, amorphous silicon carbide, or amorphous carbon, such devices when incorporated into xerographic imaging systems can result in image blurring and very rapid image deletion in a few imaging cycles, typically less than about ten. Furthermore, in these overcoated devices poor image quality with cycling is caused by an increase in the surface conductivity of the underlying amorphous silicon layer, rather than to abrasion or chemical interaction as occurs with amorphous silicon containing no protective overcoating layer. This conductivity increase is induced by the electric field existing at the surface of the overcoated device, similar to the effect resulting from the field effect in well known metal-insulator-semiconductor devices, causing a lateral spreading of the photogenerated charges in the fringe electric fields associated with line or edge images projected on the photoreceptor surface thereby resulting in undesirable image blurring and image deletion. The composition of the silicon nitride or silicon carbide has to be optimized to prevent this image blur. The material required to prevent image blur is non-stoichiometric and is not mechanically as durable, and is likely to wear off in 300,000 copies as a result of cleaning action. Also, the thickness of the overcoat in the virgin device is determined by the residual potential arising from the overcoat. Therefore, the protective overcoat thickness is limited to less than one micron. The aformentioned amorphous silicon drums must thus be replaced after about 300,000 copies at substantial cost. This disadvantage is avoided with the processes of the present invention in that the used drums can be restored and commercially reused.

Accordingly, there continues to be a need for obtaining amorphous silicon imaging members which can be repeatedly used in a number of imaging cycles. Additionally, there continues to be a need for processes for treating amorphous silicon photoconductive materials for the purpose of increasing charge acceptance and resolution thereof, and eliminating surface scratches and white spots therefrom. Moreover, there continues to be a need for restoring overcoated amorphous silicon photoconductive materials thereby resulting in the elimination of surface scratches and an increase in charge acceptance for these materials, and enabling imaging members, especially commercially used drums, to be restored rather than be disposed of. Further, there continues to be a need for processes wherein commercially used amorphous silicon photoconductive members can be treated primarily for the purpose of increasing the charge acceptance thereof. Also, there continues to be a need for direct economical processes for restoring overcoated amorphous silicon imaging members, which subsequent to restoration can be selected for incorporation into an electrophotographic imaging system, and wherein there results in many instances increased charge acceptance allowing the restored member to be useful for a substantial number of imaging cycles without causing a degradation in image quality, and specifically without resulting in images of low density and poor resolution. Furthermore, there continues to be a need for processes to refurbish or rejuvenate overcoated amorphous silicon drums that show loss of density and scratch print out subsequent to use in an imaging apparatus.

SUMMARY OF THE INVENTION

It is therefore an object of the present invention to provide processes for restoring amorphous silicon imaging members.

In yet another object of the present invention there are provided improved processes for restoring amorphous silicon substances, especially photoconductive drums with protective overcoating, with fluorine containing compositions.

In a further object of the present invention there are provided improved direct processes for restoring protective overcoated amorphous silicon photoconductive materials for the purpose of increasing the charge acceptance thereof.

A further specific object of the present invention resides in an improved process for restoring amorphous silicon photoconductive materials with fluorine containing substances, such as hydrofluoric acid, and fluorine gas for the purpose of eliminating latent surface scratches thereon.

In yet another object of the present invention there are provided processes for restoring amorphous silicon photoconductive materials wherein there results increased image resolution when these materials are incorporated in xerographic imaging apparatus.

In a further object of the present invention there are provided processes for treating commercially used, after 300,000 copies, amorphous silicon photoconductive materials with protective overcoatings thereon for the primary purpose of eliminating image defects, including known white spots.

Additionally, in another object of the present invention there are provided processes for restoring hydrogenated or halogenated amorphous silicon imaging members with protective overcoatings subsequent to their utilization in an electrophotographic imaging apparatus by subjecting the aforementioned used members to hydrogen fluoride vapors for a sufficient period of time, followed by redeposition of a new overcoat to enable a member that can be subsequently reutilized in electrophotographic imaging devices, and wherein there is obtained the achievement of images of increased resolution with substantially no white spots as compared to the unrestored member.

These and other objects of the present invention are accomplished by the provision of an improved simple, direct process for restoring amorphous silicon photoconductive members by contacting these members with fluorine containing compositions. More specifically, in one embodiment, the present invention is directed to an improved process, which comprises (1) providing an amorphous silicon photoconductive imaging member, including drums, with protective overcoatings thereon, and (2) contacting the aforementioned member substance with compositions containing fluorine for a sufficient period of time to enable the restoration thereof and in many instances an increase in the charge acceptance of the photoconductive substance, and/or the elimination of surface scratches contained thereon.

In another embodiment of the present invention there is provided a simple economical process for restoring rejected, unuseful amorphous silicon photoconductive materials, especially photoconductive drums, subsequent to their fabrication which comprises (1) providing an amorphous silicon photoconductive imaging member including drums with protective overcoatings thereon; (2) contacting the aforementioned member with compositions containing fluorine such as hydrofluoric acid for a sufficient period of time, for example from about one minute to about 240 minutes and preferably from about 10 minutes to about 60 minutes, to enable the removal of the protective overcoating; (3) washing the surface of the imaging member; (4) drying the surface of the imaging member; (5) and subsequently redepositing an overcoat of the same composition as the one removed or redepositing an overcoat of a different composition, thereby enabling the restoration thereof and in many instances an increase in the charge acceptance of the amorphous silicon photoconductive substance, and/or the elimination of surface scratches contained thereon.

In another embodiment of the present invention there is provided a simple economical process for restoring commercially used amorphous silicon photoconductive materials subsequent to their removal from an imaging apparatus, which comprises (1) providing a hydrogenated or halogenated amorphous silicon photoconductive imaging member including drums with protective overcoatings thereon; (2) contacting the aforementioned member with compositions containing fluorine such as hydrofluoric acid for a sufficient period of time, for example from about one minute to about 240 minutes and preferably from about 10 minutes to about 60 minutes, to enable the removal of the protective overcoating; (3) washing the surface of the imaging member; (4) drying the surface of the imaging member; and (5) subsequently depositing a protective overcoating thereby enabling the restoration thereof and in many instances an increase in the charge acceptance of the member photoconductive substance, and/or the elimination of surface scratches contained thereon.

In an embodiment of the present invention, there is provided a commercially used amorphous silicon imaging member or drum comprised of a supporting substrate, such as aluminum, a barrier layer, about one micron in thickness containing 100 parts per million of boron doped hydrogenated amorphous silicon with from about 10 to about 40 atomic percent of hydrogen; thereover a thick photoconductive layer from, for example, from about 5 to about 50 microns of boron doped hydrogenated amorphous silicon with from about 10 to about 40 atomic percent of hydrogen, which layer has been doped with about 10 parts per million of boron; and thereover an overcoating of silicon nitride, amorphous carbon including hydrogenated amorphous carbon, or silicon carbide of an effective thickness of, for example, 1 micron; mounting the drums subsequent to their removal from an electrophotographic imaging apparatus after from about 10,000 to about 300,000 copies have been generated with such a member, and wherein the members pass while rotating on its axis in an enclosed chamber through a trough of hydrofluoric acid, thereby etching the old overcoat and causing its removal, and reforming a new surface of hydrogenated and fluorinated amorphous silicon. The time duration of hydrofluoric exposure can vary from about 1 minute to about 60 minutes. Thereafter, the drums while still on the conveyer belt are moved into a second chamber wherein they are subjected to a deionized water spray to clean the surface of residual acid and any dirt. This operation can be accomplished in from about 1 to about 10 minutes. The drums are subsequently passed through a forced air drying oven for from about 2 to about 10 minutes. Subsequently, the drums are positioned in a plasma chamber and an overcoat of silicon carbide, silicon nitride, reference U.S. Pat. Nos. 4,663,258 and 4,666,806, the disclosures of which are totally incorporated herein by reference, and the like of up to one micron thickness is deposited by chemical vapor deposition processes of the appropriate gases in a period of from about 15 to about 60 minutes.

In another embodiment of the present invention, there is provided an improved process for restoring commercially unuseful or rejected after fabrication hydrogenated or halogenated amorphous silicon photoconductive members comprising (1) providing a hydrogenated or halogenated amorphous silicon photoconductive member comprised, for example, of a supporting substrate such as aluminum, a photoconductive layer of hydrogenated or halogenated amorphous silicon with, for example, from about 10 to about 60 atomic percent of hydrogen or halogen, respectively, and thereover a protective layer of silicon carbide, silicon nitride, or hydrogenated amorphous carbon; (2) contacting the aforementioned member with compositions containing fluorine such as hydrofluoric acid for a sufficient period of time, for example from about one minute to about 240 minutes and preferably from about 10 minutes to about 60 minutes to enable the removal of the protective overcoating; (3) washing the surface of the imaging member; (4) drying the surface of the imaging member; and (5) subsequently redepositing a protective overcoat by the chemical vapor deposition processes of silicon nitride, silicon carbide, or the like up to one micron thickness, thereby enabling the restoration thereof and in many instances an increase in the charge acceptance of the member photoconductive substance and/or the elimination of surface scratches contained thereon.

Also, in yet another embodiment, the present invention is directed to a process for restoring commercially used imaging members, which comprises (1) providing an amorphous silicon photoconductive member comprised, for example, of a supporting substrate such as aluminum, a photoconductive layer of hydrogenated or halogenated amorphous silicon with, for example, from about 10 to about 90 atomic percent of hydrogen or halogen, respectively; and thereover a protective layer of silicon carbide, silicon nitride, or hydrogenated amorphous carbon; (2) contacting the aforementioned member with compositions containing fluorine such as hydrofluoric acid for a sufficient period of time, for example, from about one minute to about 240 minutes and preferably from about 10 minutes to about 60 minutes to enable the removal of the protective overcoating; (3) washing by a deionized water spray the surface of the imaging member; (4) drying by impinging hot air the surface of the imaging member; and (5) subsequently depositing a protective top overcoating and enabling the restoration thereof thereby resulting in an imaging member that when incorporated into an electrophotographic imaging or printing apparatus enables the achievement of images with substantially no white spots as compared to the removed member.

Illustrative examples of fluorine containing substances that can be selected for the process of the present invention include hydrofluoric acid, hexafluorides, and the like with hydrofluoric acid being preferred. However, it is believed that numerous other substances can be selected providing they function as a fluorinating agent, and achieve some of the objectives of the present invention. While it is not desired to be limited by theory, it is, for example, believed that the aforementioned hydrofluoric acid vapors etch away a thin region of the scratched surface and reform the broken silicon-hydrogen and silicon-silicon bonds, thus restoring the surface.

The amount of fluorinating agent selected is dependent on many factors including, for example, the distance that the amorphous silicon photoreceptor is from the liquid level of a container containing the source of fluorine, however, generally from about 100 milliliters to about $10^6$ milliliters, and preferably from about $10^3$ milliliters to about $10^4$ milliliters of fluorinating substance are selected. Also, the amorphous silicon photoconductive member can be restored by passing it through a fluorine containing solution, or preferably contacting it with the vapors of such solutions by, for example, rotating the member above and in close proximity to the fluorine containing solution. Rotation is affected at from about 0.2 revolutions per minute to 60 revolutions per minute, and preferably from about 10 revolutions per minute to 30 revolutions per minute.

When in the fluorine containing solution, the amorphous silicon photoconductor imaging member is allowed to remain therein for an effective period, for example, in one embodiment from about 1 minute to about 20 minutes, and preferably for a period of from about 1 minute to about 10 minutes. By solution in accordance with the process of the present invention is meant a water solution of fluorine containing substance, such as hydrofluoric acid, which contains from about 25 percent by weight to about 60 percent by weight of hydrogen fluoride, and from about 75 percent by weight to about 40 percent by weight of water. This causes the removal of the protective overcoating layer and formation of a new surface. Subsequent to removal of the protective coating, the amorphous silicon photoconductive surface is washed with inert materials, such as deionized water, for example about 10,000 milliliters to about 50,000 milliliters of water being used, and allowed to dry. Other effective washing substances can be selected. Drying of the resulting member can be accomplished by a conveyer in a forced dry air oven. Thereafter, a protective overcoating is applied to the member in a plasma chamber containing an electrical discharge either by a batch process or a semi-continuous process by a mode lock arrangement, which is a multistage vaccum apparatus for semi-continuous operation. The member or drum is moved into the first chamber and pumped down. It is subsequently transferred to a second chamber which is already pumped down to high vacuum where the overcoat of silicon nitride, silicon carbide, or the like is fabricated by the decomposition of silane and ammonia or silane and methane. The drum is subsequently transferred to a third stage which is already in vacuum and subsequently removed. The three vacuum chambers are separated by vacuum seals. A continuous flow of drums can thus be maintained reducing the time required to fabricate the overcoat. Thus, the fabrication of the overcoat in the mode lock arrangement is less expensive than in a batch process.

The results of the treatment or restoration can be verified by analytical methods including Secondary Ion Mass Spectrometry (SIMS) and Electron Spectroscopy for Chemical Analysis (ESCA). These techniques revealed higher levels of fluorine on the exposed amorphous silicon regions as compared to unexposed or virgin amorphous silicon devices. Also, the charge acceptance of the amorphous silicon photoconductive member treated or restored in accordance with the process of the present invention has increased more than five times, from 80 to 400 volts, in an embodiment of the present invention.

Charge acceptance of the amorphous silicon photoconductive substance is directly related to the quality of the images obtained. Thus, for example, when the charge acceptance of untreated amorphous silicon decreases to about 80 volts from 400 volts after about 300,000 imaging cycles the density of the resulting image is unacceptable in that it decreases from about 1.2 to about less than 0.3. Eventually, the voltage decrease of the untreated amorphous silicon is significant to the extent that the density of the resulting images are close to zero, and thus in some instances are unreadable. Although this phenomenon can be minimized by a thick overcoat, in the region of deep scratches introduced during fabrication, handling or operation in the machine, the drop in charge acceptance from 400 to 80 volts in unacceptable scratch print out. The etching and the restoration of the surface in accordance with the process of the present invention results in the increase in charge acceptance from 80 to 400 volts in one embodiment.

By charge acceptance in accordance with the process of the present invention is meant the measured potential on the amorphous silicon photoreceptor immediately subsequent to charging. Charge acceptance can be determined by a number of known methods including a measurement of the surface potential of the amorphous silicon with a capacitively coupled probe mounted in close proximity to the charging corotron. Generally, a charge acceptance of from about 200 volts to about 350 volts is desired for a 10 micron thick amorphous silicon, and further it is important that this charge acceptance remain constant for over 300,000 imaging cycles.

Examples of amorphous silicon imaging members that can be treated or restored with the process illustrated herein include hydrogenated and halogenated members preferably containing from about 10 to about 50 atomic percent of hydrogen or halogen, including chlorine, fluorine or mixtures thereof. Accordingly, thus with the process of the present invention hydrogenated or halogenated, including fluorinated, imaging members subsequent to their utilization in an electrophotographic imaging apparatus can be restored, and subsequently repeatedly used for a number of imaging cycles in said apparatus by subjecting the used member to hydrogen fluoride vapors, washing, and drying, and thereafter applying the removed protective overcoating. Generally, thus many hydrogenated or halogenated amorphous silicon imaging members are initially useful for about 300,000 copies in an electrophotographic imaging device at which time they must be replaced since images of lower density as compared to the density of 1.2 obtained with the virgin drum, scratch print out and decreased resolution, for example, result. Rather than discarding these members as is presently the practice, they can be restored and reused by following the process as illustrated herein wherein these members are exposed, for example, to hydrogen fluoride vapors for an effective time period. The restored members with new protective overcoatings thereon, which can then be reincorporated into the imaging apparatus, enable the achievement of images of excellent resolution with substantially no white spots as compared to the unrestored member, that is the member that has been utilized for 300,000 copies. Examples of imaging members that may be restored with the processes of the present invention are illustrated, for example, in many of the U.S. patents mentioned herein, including U.S. Pat. Nos. 4,634,647 and 4,265,991.

Photoresponsive imaging members treated and/or restored in accordance with the process of the present invention can be incorporated into various imaging systems, particularly xerographic imaging systems. In these systems, latent electrostatic latent images are formed on the devices involved, followed by developing the images with known developer compositions, subsequently transferring the image to a suitable substrate, and optionally permanently affixing the image thereto. The amorphous silicon photoconductor devices selected for these imaging systems, subsequent to treatment or restoration in accordance with the process of the present invention, are useful for generating images of high resolution, and high density for an extended number of imaging cycles. Further, subsequent to treatment in accordance with the process of the present invention the undesirable white spots caused during fabrication are eliminated or minimized thereby providing for images of high quality, and excellent resolution. Also, subsequent to treatment in accordance with the process described herein, the aging of the amorphous silicon as described hereinbefore, which appears as a loss of image resolution, is substantially eliminated.

While it is not desired to be limited by theory, it is believed that untreated amorphous silicon when subjected to an electrophotographic environment causes the silicon hydrogen bonds to fracture thus creating surface scratches thereon, and decreasing the charge acceptance of such devices. More specifically, it is believed as indicated hereinbefore that the fractured bonds in the presence of water vapor form silicon hydroxide bonds thus altering the characteristics of the surface. In any event, surface abrasion causes the formation of conductive states on the surface of the amorphous silicon, and during charging this results in a reduction in charge acceptance.

The imaging member that may be restored with the processes of the present invention is comprised in an embodiment of a supporting substrate of a thickness of from about 0.01 inch to about 0.2 inch, a barrier layer of from about 0.01 micron to about 0.5 micron in thickness containing from about 50 to 10,000 ppm boron doped hydrogenated amorphous silicon, a photoconducting layer of hydrogenated or halogenated amorphous silicon with 10 to 40 atomic percent of hydrogen or halogen, respectively, in a thickness of from about 5 microns to about 50 microns and an overcoating protective layer of a thickness of from about 0.01 micron to about 1.0 micron. The aforementioned photoconducting layers may be doped with components such as boron in amounts of from about 1 ppm to about 20 ppm to enable hole transport. Examples of protective layers include those as illustrated herein such as nonstoichiometric silicon nitride, and silicon carbide; a dual layer overcoat containing nonstoichiometric silicon nitride overcoated with stoichiometric silicon nitride, amorphous carbon, and the like with thickness of, for example, from about 0.01 micron to about one micron.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

EXAMPLE I

A two layer hydrogenated amorphous silicon photoreceptor was fabricated on an aluminum drum with a length of 400 millimeters by introducing into a reaction chamber containing the drum 200 sccm of a silane gas doped with 100 parts per million of diborane, the full apparatus and process conditions being as illustrated in U.S. Pat. Nos. 4,446,380; 4,666,806 and 4,663,258, the disclosures of which are totally incorporated herein by reference. The throttle present on the reactor was adjusted to obtain a plasma pressure in the reaction vessel of 375 microns while the $13.6\times10^6$ cycles of radio frequency (rf) power of 160 watt was applied between the rotating aluminum drum maintained at a temperature of 230° C., and a concentric counterelectrode contained in the reactor. A blocking barrier layer or first layer of hydrogenated, 25 atomic percent of hydrogen, amorphous silicon doped with 100 parts per million of boron in a thickness of 5,000 Angstroms was deposited on the aluminum drum after 5 minutes.

Subsequently, the bulk or second layer is applied to the blocking layer by introducing into the reaction chamber 200 sccm of silane gas and 6 sccm of silane gas doped with 100 parts per million of diborane. The plasma pressure in the chamber was maintained at 800 microns, the rf power was 100 watts, and the deposition time was 180 minutes. There resulted in a thickness of 17 microns a bulk photoconductive layer of hydrogenated amorphous silicon containing 15 atomic percent hydrogen doped with 3 parts per million of boron.

The aforementioned prepared imaging member was then incorporated into the Xerox Corporation 3100® imaging apparatus and images of acceptable resolution, subsequent to development and fixing, were generated for about 10,000 copies, at which time the images were substantially not visible, and the images contained numerable scratch print outs and white spots.

The imaging member was then removed from the Xerox 3100® apparatus and exposed to HF vapor by rotating the hydrogenated amorphous silicon drum for 15 minutes over a trough containing an HF solution, about 60 percent of water, and about 40 percent of hydrofluoric acid. The surface containing silicon hydrogen and fluorine was reformed by this treatment, and this surface of the member was subsequently washed with 3,000 millilieters of deionized water for about 10 minutes. Thereafter, the member was dried by blowing hot air for 10 minutes resulting in a restored imaging member in that when this member was then reincorporated into the Xerox Corporation 3100® imaging apparatus images of excellent resolution with no background deposits were generated for about 20,000 copies.

EXAMPLE II

A three layer photoresponsive imaging member was prepared by repeating the procedure of Example I to fabricate the first two layers. A third overcoat layer of silicon nitride was fabricated by flowing into the apparatus 86 sccm of silane gas and 114 sccm of ammonia. Further, the plasma pressure was maintained at 300 microns, the rf power selected was 40 watts, and the deposition time for the overcoating was 4 minutes. There resulted in a thickness of 0.05 micron an overcoating of silicon nitride with an excess of silicon, that is a nitrogen to silicon atomic ratio of 0.45, or 31 percent of nitrogen. The aforementioned prepared imaging members was then incorporated into the Xerox Corporation 3100® imaging apparatus and images of excellent resolution were generated subsequent to development and fixing for about 100,000 copies, at which time scratch print out could be seen on the images. After 200,000 copies, the density of the images was reduced and some white spots could be seen. After 300,000 copies, no images could be seen.

The imaging member was then removed from the above Xerox Corporation 3100® and exposed to HF vapor by rotating the hydrogenated amorphous silicon photoconductive drum for 15 minutes over a trough containing an HF solution, about 60 percent of water, and about 40 percent of hydrofluoric acid. The overcoat or the portion of the overcoat remaining of silicon nitride was etched away and a new surface containing silicon hydrogen and fluorine was reformed by this treatment. The new surface of the remaining member was subsequently washed with 3,000 milliliters of deionized water for about 10 minutes. Thereafter, the member was dried by blowing hot air on it for 10 minutes. The drum was subsequently reintroduced into the plasma reactor, and a new overcoat of silicon nitride deposited by repeating the above overcoating process. The aforementioned restored imaging member was then incorporated into the aforementioned Xerox Corporation 3100® imaging apparatus and images of excellent resolution subsequent to development and fixing, about ten line pair per millimeters, were generated for over 150,000 copies.

EXAMPLE III

A three layer photoresponsive imaging member was prepared by repeating the procedure of Example I to fabricate the first two layers. A third overcoat layer of silicon carbide was fabricated by flowing 86 sccm of silane gas and 114 sccm of methane into the apparatus chamber. Further, the plasma pressure was maintained at 300 microns, the rf power selected was 40 watts, and the deposition time for the overcoating was 4 minutes. There resulted in a thickness of 0.05 micron an overcoating of silicon carbide. The aforementioned prepared imaging member was then incorporated into the Xerox Corporation 3100® imaging apparatus and images of excellent resolution were generated subsequent to development and fixing for about 100,000 copies, at which time scratch print out could be seen on the images. After 200,000 copies, the density of the images was reduced and some white spots could be seen. After 300,000 copies, no images could be seen.

The imaging member was then removed from the Xerox Corporation 3100® and exposed to HF vapor by rotating the hydrogenated amorphous silicon photoconductive drum for 15 minutes over a trough containing an HF solution, about 60 percent of water, and about 40 percent of hydrofluoric acid. The remaining overcoat of silicon carbide was etched away and a new surface of silicon, hydrogen and fluorine was reformed by this treatment. The new surface of the remaining member was subsequently washed with 3,000 milliliters of deionized water for about 10 minutes. Thereafter, the member was dried by blowing hot air thereon for 10 minutes. The drum was subsequently reintroduced into the plasma reactor, and a new overcoat of silicon carbide deposited by repeating the above overcoating process. The restored imaging member was then incorporated into the Xerox Corporation 3100® imaging apparatus and images of excellent resolution were generated subsequent to development and fixing for 150,000 copies.

Although the invention has been described with reference to specific preferred embodiments, it is not intended to be limited thereto. Rather, those skilled in the art will recognize that variations and modifications may be made therein which are within the spirit of the invention, and within the scope of the following claims.

What is claimed is:

1. A process for restoring imaging members, which comprises (1) providing, subsequent to its utilization and removal from an electrophotographic imaging device, an amorphous silicon photoconductive imaging member with a protective overcoating; (2) contacting this member with a fluorine containing composition for an effective time period enabling the removal of the protective layer; (3) washing and drying the surface of the resulting imaging member; and (4) subsequently depositing a protective layer thereover, and wherein the fluorine containing composition is selected from the group consisting of hydrofluoric acid and hexafluorides.

2. A process in accordance with claim 1 wherein the photoconductive member contains hydrogen or halogen.

3. A process in accordance with claim 1 whereby there results an imaging member that when incorporated into an electrophotographic imaging apparatus enables the achievement of images with substantially no white spots as compared to the removed member.

4. A process for restoring imaging members, which comprises (1) providing, subsequent to its utilization and removal from an electrophotographic imaging apparatus, a hydrogenated or halogenated amorphous silicon imaging member with a protective overcoating; (2) contacting this member with a fluorine containing composition for an effective time period enabling the removal of the protective layer; (3) washing and drying the surface of the resulting imaging member; and (4) subsequently depositing a protective layer thereover, and wherein the fluorine containing composition is selected from the group consisting of hydrofluoric acid and hexafluorides.

5. A process for restoring hydrogenated or halogenated amorphous silicon imaging members, which comprises (1) obtaining, subsequent to its utilization in and removal from an electrophotographic imaging member, a hydrogenated or halogenated amorphous silicon imaging member with a protective overcoating; (2) subsequently contacting this member with fluorine containing compositions for a period of from about one minute to about 240 minutes enabling the removal of the protective layer; (3) washing and drying the surface of the resulting imaging member; and (4) subsequently depositing a protective layer thereover thereby enabling the resulting member to be reincorporated into the electrophotographic imaging apparatus and permitting the achievement of images of increased resolution with substantially no white spots as compared to the removed member, and wherein the fluorine containing composition is selected from the group consisting of hydrofluoric acid and hexafluorides.

6. A process in accordance with claim 5 wherein the imaging member contains from about 10 to about 40 atomic percent of hydrogen.

7. A process in accordance with claim 5 wherein the imaging member contains from about 10 to about 50 atomic percent of fluorine.

8. A process in accordance with claim 5 wherein the imaging member is subjected to vapors of hydrogen fluoride for a period of from about 10 minutes to about 60 minutes.

9. A process in accordance with claim 5 wherein the imaging member is subjected to vapors of hydrogen fluoride emitted from a solution containing from about 75 percent by weight to about 40 percent by weight of water.

10. A process in accordance with claim 5 wherein the imaging member is subjected to a fluorine gas.

11. A process in accordance with claim 5 wherein washing is accomplished by a spray of deionized water or organic solvents.

12. A process in accordance with claim 11 wherein washing is accomplished with an aliphatic alcohol, an ether, or mixtures thereof.

13. A process in accordance with claim 12 wherein washing is accomplished with ethanol, methanol, or tetrahydrofuran.

14. A process in accordance with claim 5 wherein drying is accomplished by blowing ambient or hot air onto the imaging member.

15. A process in accordance with claim 5 wherein deposition of the protective overcoating is accomplished in a plasma reactor by glow discharge decomposition of gases comprised of a mixture of silane and ammonia, or silane and methane.

16. A process in accordance with claim 5 wherein the hydrogenated or halogenated amorphous silicon imaging member is utilized for 300,000 copies prior to restoration.

17. A process in accordance with claim 5 wherein the restoration is accomplished with a hydrogen fluoride solution containing about 60 percent by weight of water and 40 percent by weight of hydrofluoric acid, and the imaging member is subjected to hydrogen fluoride vapors for a period of one hour.

18. A process for restoring halogenated amorphous silicon imaging members which comprises (1) obtaining a hydrogenated or halogenated amorphous silicon member with a protective overcoating subsequent to its utilization in and removal from an electrophotographic imaging device; (2) thereafter contacting this member with hydrogen fluoride vapors for a period of from about one minute to about 240 minutes thereby enabling the removal of the protective layer; (3) washing and drying the surface of the resulting imaging member; and (4) subsequently depositing a protective layer thereover enabling an imaging member that can be reincorporated into an electrophotographic imaging device, and wherein there are obtained images of increased resolution with substantially no white spots as compared to the removed hydrogenated or halogenated member, and wherein the fluorine containing composition is selected from the group consisting of hydrofluoric acid and hexafluorides.

19. A process in accordance with claim 18 wherein the member is subjected to vapors of hydrogen fluoride for a period of from about 10 minutes to about 60 minutes.

20. A process in accordance with claim 18 wherein there is selected for the formation of said vapors a hydrofluoric solution containing from about 25 percent by weight to about 60 percent by weight of hydrogen fluoride, and from about 75 percent by weight to about 40 percent by weight of water.

21. A process in accordance with claim 18 wherein the imaging member is contacted with hydrofluoride vapors for a period of one hour with vapors originating from a hydrogen fluoride solution comprised of 60 percent by weight of water and 40 percent by weight of hydrofluoric acid.

22. A process in accordance with claim 18 wherein the imaging member is contacted with a fluorine gas.

23. A process in accordance with claim 1 wherein images with substantially no white spots are obtained with the restored member.

24. A process in accordance with claim 1 wherein the protective overcoating is comprised of silicon nitride, silicon carbide, or amorphous carbon.

25. A process in accordance with claim 2 wherein the protective overcoating is comprised of silicon nitride, silicon carbide, or amorphous carbon.

26. A process in accordance with claim 5 wherein the protective overcoating is comprised of silicon nitride, silicon carbide, or amorphous carbon.

27. A process in accordance with claim 1 wherein the amorphous silicon imaging member contains dopants therein.

28. A process in accordance with claim 27 wherein the dopants are comprised of boron or phosphorus.

29. A process in accordance with claim 5 wherein hydrogen is present in an amount of from about 10 to about 40 atomic weight percent and halogen is present in an amount of from about 10 to about 40 atomic weight percent.

30. A process for restoring imaging members, which comprises (1) providing, subsequent to its utilization and removal from an electrophotographic imaging device, an amorphous silicon imaging member with a protective overcoating; (2) contacting this member with a fluorine containing composition for an effective time period enabling the removal of the protective layer; and (3) washing and drying the surface of the resulting imaging member, and wherein the fluorine containing composition is selected from the group consisting of hydrofluoric acid and hexafluorides.

31. A process for restoring hydrogenated or halogenated amorphous silicon imaging members, which comprises (1) obtaining, subsequent to its utilization in and removal from an electrophotographic imaging member, a hydrogenated or halogenated amorphous silicon imaging member with a protective overcoating; (2) subsequently contacting this member with fluorine containing compositions for a period of from about one minute to about 240 minutes enabling the removal of the protective layer; and (3) washing and drying the surface of the resulting imaging member.

32. A process in accordance with claim 1 wherein the restored imaging member is comprised of a supporting substrate, a photoconductive layer of hydrogenated or halogenated amorphous silicon, and a protective overcoating layer in contact with the photoconductive layer.

33. A process in accordance with claim 4 wherein the restored imaging member is comprised of a supporting substrate, a photoconductive layer of hydrogenated or halogenated amorphous silicon, and a protective overcoating layer in contact with the photoconductive layer.

34. A process in accordance with claim 5 wherein the restored imaging member is comprised of a supporting substrate, a photoconductive layer of hydrogenated or halogenated amorphous silicon, and a protective overcoating layer in contact with the photoconductive layer.

35. A process in accordance with claim 18 wherein the restored imaging member is comprised of a supporting substrate, a photoconductive layer of hydrogenated or halogenated amorphous silicon, and a protective overcoating layer in contact with the photoconductive layer.

* * * * *